US006612063B1

(12) United States Patent
Sigg

(10) Patent No.: US 6,612,063 B1
(45) Date of Patent: Sep. 2, 2003

(54) WEAPON, IN PARTICULAR A SELF-LOADING PISTOL

(76) Inventor: Hans-Peter Sigg, Holzgasse 4, D-79798 Jestetten (DE)

( * ) Notice: Subject to any disclaimer, the term of this patent is extended or adjusted under 35 U.S.C. 154(b) by 62 days.

(21) Appl. No.: 09/648,511

(22) Filed: Aug. 25, 2000

(30) Foreign Application Priority Data

Jul. 22, 1998 (DE) ..... 198 32 777

(51) Int. Cl.[7] ..... F41C 27/00

(52) U.S. Cl. ..... 42/106; 42/20; 42/70.01; 42/70.02; 42/70.03; 42/70.04; 42/70.05; 42/70.06; 42/70.1; 42/70.11; 42/90; 42/1.01; 42/1.07; 42/16; 102/430; 102/469

(58) Field of Search ..... 42/16, 20, 70.01, 42/70.02, 70.03, 70.04, 70.05, 70.06, 70.08, 70.1, 70.11, 90, 1.01, 1.07, 106; 102/430, 469

(56) References Cited

U.S. PATENT DOCUMENTS 1,650,908 A * 11/1927 Ramsey
1,887,324 A * 11/1932 Pocoroba
2,585,195 A * 2/1952 Walker
3,747,247 A * 7/1973 McNair ..... 42/1.14
4,035,942 A * 7/1977 Wiczer ..... 42/78
4,131,064 A * 12/1978 Ryan et al. ..... 102/293
4,150,624 A * 4/1979 Hammond
4,175,346 A * 11/1979 Zemsky ..... 42/76.01
4,575,962 A * 3/1986 Rogak et al.
5,485,789 A * 1/1996 Collier
5,685,100 A * 11/1997 Atchison ..... 42/1.01
5,698,816 A * 12/1997 Roxby ..... 102/516
5,898,125 A * 4/1999 Mangolds et al. ..... 102/439
6,293,204 B1 * 9/2001 Regen

* cited by examiner

*Primary Examiner*—Michael J. Carone
*Assistant Examiner*—John Richardson
(74) *Attorney, Agent, or Firm*—Bachman & LaPointe, P.C.

(57) ABSTRACT

In a weapon, in particular a self-loading pistol, having a barrel (1) and a breech block (4), it being possible for a cartridge (2) to be fired in the barrel (1) by being acted upon by means of a firing pin (7), to identify a fired cartridge (2) and/or to increase the precision during the shot, a contact region (10) of the breech block (4) with the cartridge (2) has at least one prominence (11) and/or recess (12).

5 Claims, 3 Drawing Sheets

WEAPON, IN PARTICULAR A SELF-LOADING PISTOL

DESCRIPTION

Figure 1:
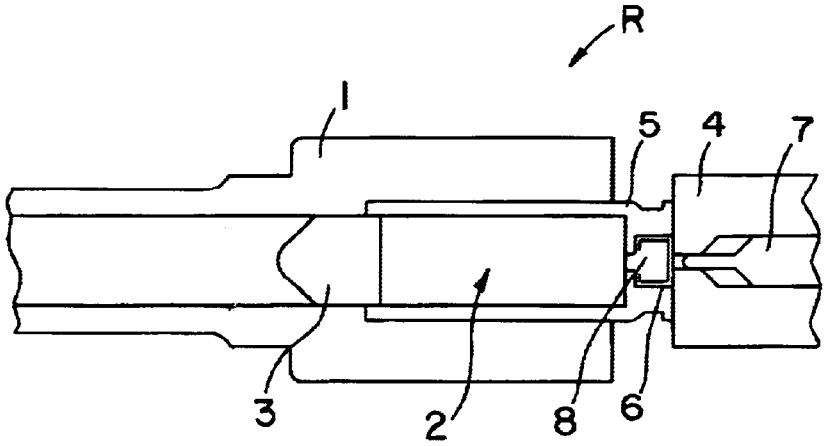

The present invention relates to a weapon, in particular a self-loading pistol, having a barrel and a breech block, it being possible for a cartridge to be fired in the barrel by being acted upon by means of a firing pin.

Such weapons, in particular self-loading pistols, are known and are obtainable on the market in the widest variety of forms and styles.

A disadvantage with the hitherto known weapons is that a breech block and a barrel have too much play during the shot. This causes a loss of precision during the shot.

It is also a disadvantage that, with a conventional fired cartridge, correlation with the fired weapon is possible only with great difficulty. This is a disadvantage, for example, when rationed ammunition and in particular a certain quantity of issued ammunition to be fired is to be monitored after the shooting.

The object of the present invention is to provide a weapon of the type mentioned at the beginning with which the precision during the shot is considerably increased and with which correlation and identification of a fired cartridge with respect to a fired weapon is possible in a well-defined manner.

This object is achieved by virtue of the fact that, to identify a fired cartridge and/or to increase the precision during the shot, a contact region of the breech block with the cartridge has at least one prominence and/or recess.

In the present invention, a recess or a prominence is arranged in particular in the impact base of the breech block. The prominence and recess are preferably arranged around the region of a firing-pin opening in the breech block. A contact region between impact base and cartridge and its sleeve and in particular its percussion cap is formed during the shot.

Especially when the shot is fired, the percussion cap is forced into an indentation or wrapped around a prominence by the high operating gas pressure produced in the cartridge. A reliable connection between the breech block and the barrel, is also formed during the common recoil. This reliable connection free of play is maintained until the gas pressure drops and/or the weapon is unlocked. In these phases, the bullet has already left the barrel, so that there is no play during the shooting performance or while the bullet in the barrel is being accelerated out of the latter.

In this case, a wide variety of indentations, for example groove-like or annular-ring-like indentations, may be provided in the contact region, preferably in the region of the percussion cap in the impact base of the breech block.

However, within the scope of the present invention, it is also intended that the contact region in the impact base can also lie outside the percussion cap at the end face due to prominences, teeth or the like in order to fix and secure the sleeve in a manner free of play relative to the breech block and thus to fix and secure the barrel during the shot. It is merely important that the prominences do not project out of the plane of the impact base.

Furthermore, the present inventive idea is also intended to include the fact that the impact base of the breech block is designed to be interchangeable for certain ammunition, for certain shooting performance. The aim here is to provide different prominences and/or recesses which are correspondingly suitable for different ammunition having different percussion caps of different material in order to ensure identification and/or to ensure that the sleeve is secured in a manner free of play during the shot.

Especially for the identification, letters, numbers, symbols or the like of many different types, also in combination, may be provided here as prominences. The fired cartridge can be correlated with the fired weapon in a well-defined manner. This is especially advantageous for shooting organizations of the armed forces or of the police or for the Federal Border Police, for example, if special ammunition is fired for example. In this way, it is easy to check the ammunition issued and fired.

For combating crime, it may also be advantageous to additionally provide identification which if need be is invisible to the naked eye in order to identify a cartridge sleeve. By means of metallurgical examinations, surface etching, precision grinding finishes or even radiographic examinations, invisible identification in the percussion cap and/or in the cartridge can be filtered out in order to draw conclusions about the fired weapon. This is especially important in combating crime.

Figure 2:
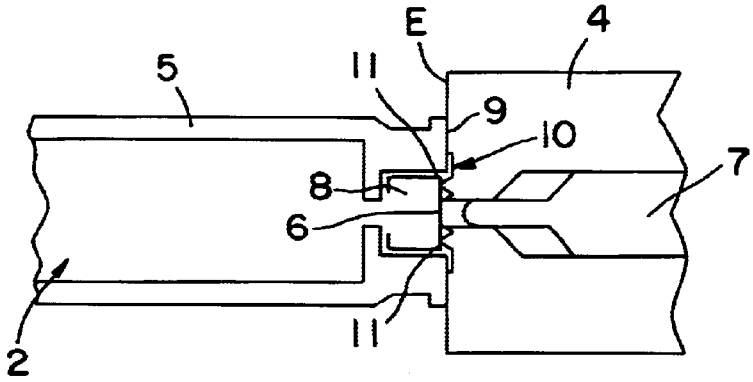
Figure 3:
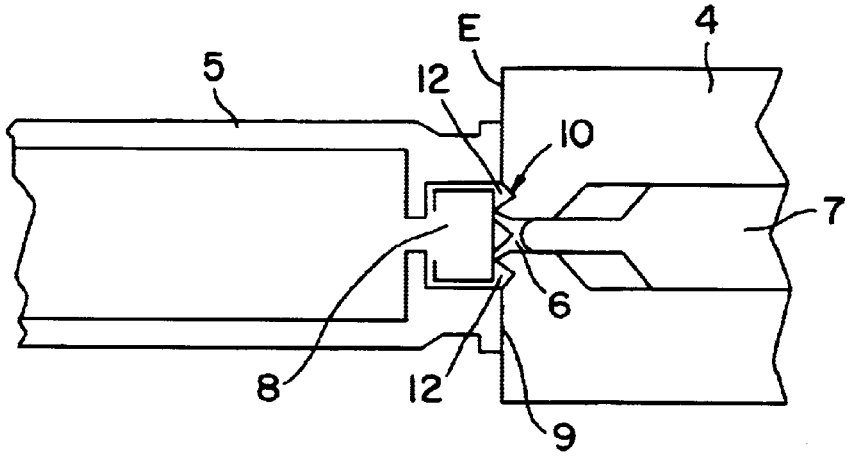
Figure 4:
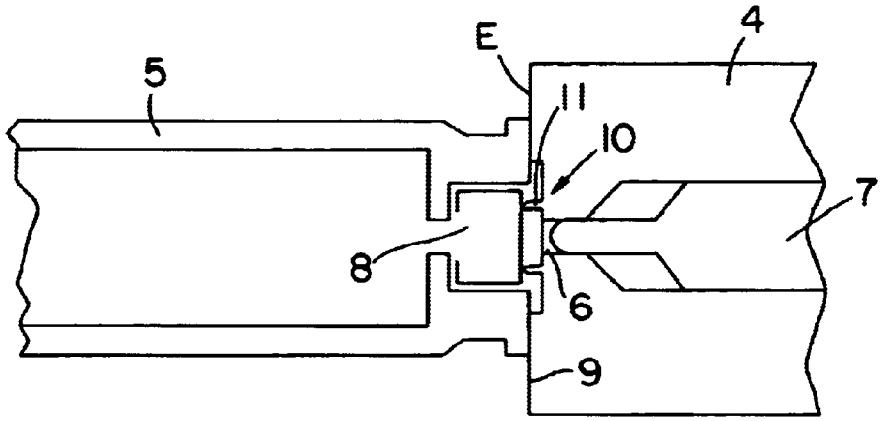
Figure 5:
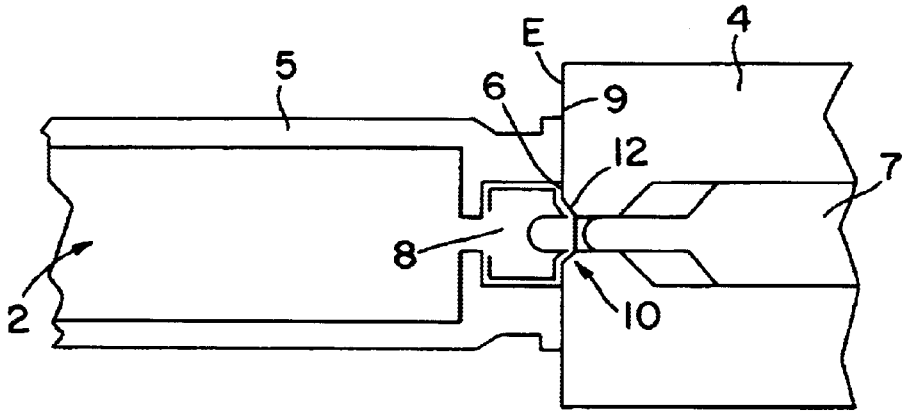
Figure 6:
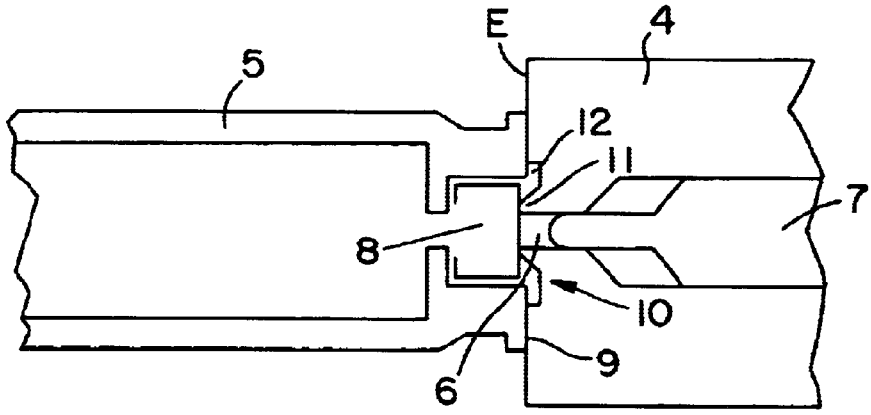
Figure 7:
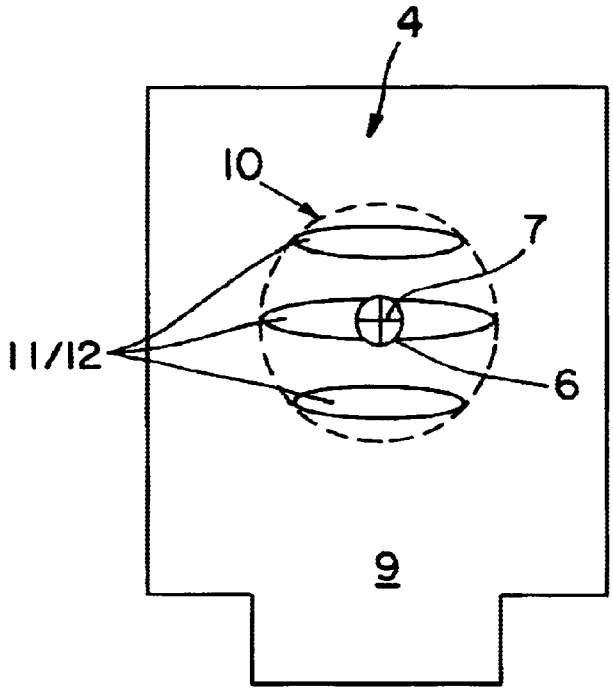
Figure 8:
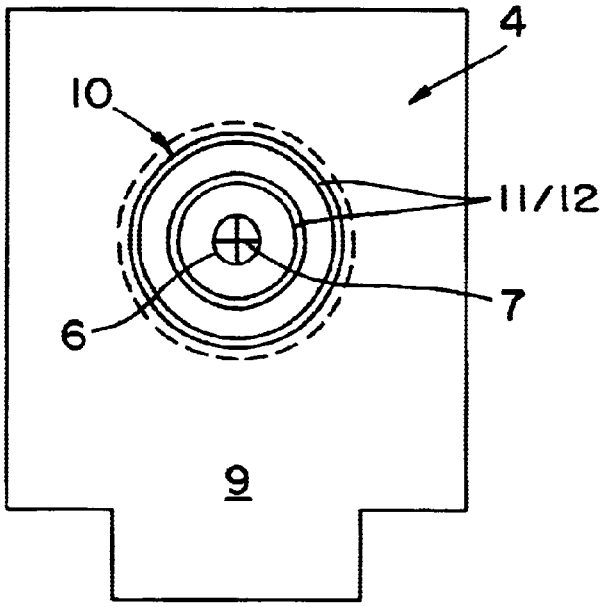

Further advantages, features and details of the invention follow from the description below of preferred exemplary embodiments and with reference to the drawing, in which:

| | |
|---|---|
| FIG. 1 | shows a schematic cross section through a part of a weapon in the region between barrel and breech block, with inserted cartridge; |
| FIG. 2 | shows an enlarged schematic partial cross section according to FIG. 1; |
| FIG. 3 | shows a partial cross section through a connecting point in the contact region between cartridge and breech block of a further exemplary embodiment; |
| FIG. 4 | shows a partial cross section through a further exemplary embodiment of a contact region between cartridge sleeve and an impact base of a breech block; |
| FIGS. 5 and 6 | show further schematic cross sections of further exemplary embodiments according to FIG. 1; |
| FIG. 7 | shows an at least partial plan view of an impact base of a breech block with prominences and/or recesses according to the invention; |
| FIG. 8 | shows an at least partial plan view of a further exemplary embodiment of an impact base of a breech block according to FIG. 7. |

According to FIG. 1, a weapon R according to the invention has a barrel 1 in which a cartridge 2 sits for delivering and firing a bullet 3. In this case, the cartridge 2, in particular its sleeve 5, is held in the barrel 1 by a schematically shown breech block 4.

Preferably provided in the center of the breech block 4 is a firing-pin opening 6, through which a firing pin 7, acted upon by pressure, strikes a percussion cap 8 of the cartridge 2 in order to fire the latter.

In particular, an impact base 9 of the breech block 4 forms a stop surface for the cartridge 2 or for the sleeve 5. In this case, the percussion cap 8 bears at least partly against the impact base 9 of the breech block 4. Only in the region of the firing-pin opening 6 does the sleeve 5 or the percussion cap 8 have no surface contact with the, impact base 9 of the breech block 4.

However, it is essential in the present invention that at least one prominence 11 and/or recess 12, see FIG. 3, is provided in a contact region 10 in the breech block 4.

A plurality of prominences 11 and/or recesses 12 are preferably provided in the impact base 9 of the breech block 4 outside the firing-pin opening 6 in the region of the percussion cap 8. However, these prominences 11 and/or recesses 12 do not project beyond a plane of the impact base 9.

In this case, within the scope of the present invention, the intention is that corresponding prominences 11 and/or recesses 12 can be provided outside the region of the percussion cap 8 in the impact base 9 of the breech block 4 in the contact region between sleeve 5 and breech block 4.

As can be seen in particular from FIG. 4, a cartridge 2, in particular a sleeve 5, is shown after the shot. A corresponding prominence 11 forms in the percussion cap 8 when the percussion cap and in particular the sleeve 5 are inflated by the high gas pressure during the shot. In the process, the prominence 11 is reshaped by the percussion cap 8. The prominence 11 is accordingly reproduced on the percussion cap 8 or even on the end face of the sleeve 5.

Especially during the shot, while the operating gas pressure increases to a very high degree, the cartridge 2 is secured against play, vibrations and the like by means of the recesses 12 and/or prominences 11 of the breech block 4. In this way, the cartridge 2 is exactly fixed relative to the breech block 4 during the shot and permits no axial play. Since the sleeve 5 also inflates in the outer radial region during the shot and bears tightly against the barrel 1, the barrel 1 is also secured in a manner free of play relative to the breech block 4. At the same time, the discharged cartridge 2 may be identified in a certain manner via the selection of the corresponding prominences 11 and/or recesses 12.

In the preferred exemplary embodiment, the prominences 11 and/or recesses 12 are provided in the contact region 10, in particular between the impact base 9 and the percussion cap 8 outside the firing-pin opening 6, as FIG. 5 in particular also shows.

The exemplary embodiment according to FIG. 6 shows a similar situation, the prominence 11 being formed from the impact base 9 in a lenticular manner.

An important feature in the present invention is not only the centering of the cartridge 2 during the shot but also the identification and correlation of a fired cartridge 2, in particular of the sleeve 5, with respect to a fired weapon. This enables the ammunition which is to be fired to be identified and monitored. Such prominences 11 or recesses 12 may also be designed to be very small, so that such identification can be recognized, for example, only with optical instruments. Possible combinations between a very small identification as prominence 11 or recess 12 and corresponding prominences 11 or recesses 12 with greater penetration depths may likewise be provided here.

Within the scope of the present invention, it is also intended here that the impact base 9 of the breech block 4 can also be assigned as an insert to the breech block 4 if need be in a replaceable and/or interchangeable manner. In this way, different impact bases 9 can be inserted into the breech block 4 in order to ensure the precision and identification for a quite definite shooting performance.

Corresponding plan views of impact bases 9 of breech blocks 4 are shown in FIGS. 7 and 8 in which the prominences 11 and/or recesses 12 are provided as transverse grooves or transverse prominences or as radially arranged grooves or prominences in the contact region 10, preferably around the firing-pin opening 6. A combination of numbers or symbols is also conceivable here.

List of Designations

| | |
|---|---|
| 1 | Barrel |
| 2 | Cartridge |
| 3 | Bullet |
| 4 | Breech block |
| 5 | Sleeve |
| 6 | Firing-pin opening |
| 7 | Firing pin |
| 8 | Percussion cap |
| 9 | Impact base |
| 10 | Contact region |
| 11 | Prominence |
| 12 | Recess |
| R | Weapon |
| E | Plane |

What is claimed is:

1. A weapon comprising:

a barrel for receiving a cartridge;

a breech block which receives a firing pin for acting on a cartridge in the barrel, the breech block includes an impact base which faces the barrel and includes a firing-pin opening through which the firing-pin passes to strike a percussion cap of the cartridge, the impact face of the breech block is provided with at least one of a prominence and a recess arrange in a contact region around the firing-pin opening which marks the percussion cap of the cartridge when the weapon is fired whereby the weapon can be identified by the fired cartridge wherein the at least one prominence and recess does not project beyond a plane (E) of the impact base.

2. The weapon as claimed in claim 1, wherein the at least one prominence and recess of the breech block is formed from symbols, letters, numbers and combinations thereof.

3. The weapon as claimed in claim 1, wherein the contact region of the breech block is interchangeable.

4. The weapon as claimed in claim 3, wherein the contact region of the breech block is interchangeable in the region of the percussion cap.

5. The weapon as claimed in claim 1, wherein the at least one prominence and recess is formed from transverse grooves, radial grooves, indentations, countersunk portions and combinations thereof.

* * * * *